US007638251B2

(12) United States Patent
Yamazaki et al.

(10) Patent No.: US 7,638,251 B2
(45) Date of Patent: Dec. 29, 2009

(54) TONER

(75) Inventors: Katsuhisa Yamazaki, Numazu (JP); Shuichi Hiroko, Susono (JP); Shuhei Moribe, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 213 days.

(21) Appl. No.: 11/671,872

(22) Filed: Feb. 6, 2007

(65) Prior Publication Data

US 2007/0141499 A1 Jun. 21, 2007

Related U.S. Application Data

(63) Continuation of application No. PCT/JP2006/321921, filed on Oct. 26, 2006.

(30) Foreign Application Priority Data

Oct. 26, 2005 (JP) ..... 2005-310876

(51) Int. Cl.
*G03G 9/087* (2006.01)

(52) U.S. Cl. ..... 430/109.3; 430/111.4

(58) Field of Classification Search ..... 430/109.3, 430/111.4

See application file for complete search history.

(56) References Cited

U.S. PATENT DOCUMENTS

| | | | | |
|---|---|---|---|---|
| 5,707,771 | A | 1/1998 | Matsunaga | |
| 5,976,752 | A | 11/1999 | Matsunaga | |
| 6,881,527 | B2 | 4/2005 | Moribe et al. | |
| 2002/0098431 | A1 * | 7/2002 | Fujikawa et al. | 430/106.2 |
| 2004/0161688 | A1 * | 8/2004 | Itakura et al. | 430/108.4 |
| 2005/0106485 | A1 * | 5/2005 | Yamazaki et al. | 430/106.1 |
| 2007/0105033 | A1 | 5/2007 | Moribe | |

FOREIGN PATENT DOCUMENTS

| | | |
|---|---|---|
| JP | 8199061 | 8/1996 |
| JP | 08234480 A | 9/1996 |
| JP | 11194536 | 7/1999 |
| JP | 2000-003077 | 1/2000 |
| JP | 2000056511 | 2/2000 |
| JP | 2005-181658 | 7/2005 |
| JP | 2005-265958 | 9/2005 |

OTHER PUBLICATIONS

IPER mailed May 8, 2008 in PCT/JP2006/321921.

* cited by examiner

*Primary Examiner*—John L Goodrow
(74) *Attorney, Agent, or Firm*—Fitzpatrick, Cella, Harper & Scinto

(57) ABSTRACT

The invention provides a toner which is excellent in its low-temperature fixing property and high-temperature offset resistance regardless of the types of paper, and constantly provides high-quality images regardless of environments and does not generate image defects even after prolonged use. In a master curve of the toner at a reference temperature of 150° C., a difference between a storage modulus at a frequency of 0.1 Hz and a storage modulus at a frequency of 1000 Hz is set in a rage from 0 to $2.5\times10^5$ Pa, where the activation energy determined from a shift factor is brought to a range from 50 to 130 kJ/mol.

5 Claims, No Drawings

TONER

This application is a continuation of International Application No. PCT/JP2006/321921, filed on Oct. 26, 2006, which claims the benefit of Japanese Patent Application No. 2005-310876 filed on Oct. 26, 2005.

BACKGROUND OF THE INVENTION

1. Field of the Invention

The present invention relates to a toner for use in an image forming method such as an electrophotographic process for visualizing an electrostatic charge image, or in a toner jet method.

2. Description of the Related Art

Various image forming methods, such as an electrostatic recording method, a magnetic recording method and a toner jet method, have been known.

Recently, in a copying apparatus, miniaturization, weight saving, high process speed and reliability are increasingly sought. Such a copying apparatus is now being utilized not only for the so-called office copier for copying an original, but also as a digital printer for a computer output, for copying a high definition image such as graphic designs, and for light printing (print on demand applications capable of producing various kinds of small volume printed matter, ranging from document editing by the aid of a personal computer to copying and book binding). For this reason, a fixing ability for various types of paper has been required.

As a resin for a toner, a polyester resin and a vinyl-type copolymer such as a styrene-type resin have been primarily utilized. Polyester resin is basically excellent in its low-temperature fixing ability, but is also disadvantageous in that an offset phenomenon is liable to occur at high temperature. In order to rectify such a drawback, if the viscosity of the polyester resin is raised by increasing the molecular weight thereof, not only the low-temperature fixing ability but also crushability in toner production is lowered, thereby becoming unsuitable for forming finer toner particles.

The vinyl-type copolymer such as styrene-type resin is excellent in crushability in toner production and in high-temperature offset resistance because a higher molecular weight can be easily obtained. However, in order to improve the low-temperature fixing property, if the molecular weight is reduced, the blocking resistance and the developing property are lowered.

In order to effectively exploit the advantages of these two resins and to cover the drawbacks thereof, a toner is disclosed using at least two of a polyester resin, a styrene-type resin, and a resin formed by reacting parts of a polyester resin and a styrene-type resin (see, for example, Japanese Patent Application Laid-open Nos. H11-194536 and 2000-056511).

These technologies can improve the compatibility between the polyester resin and the vinyl-type copolymer and provide a toner having a wide fixing temperature range, which however is still insufficient to accomplish the same fixing property for various types of paper, ranging from thick paper having surface irregularities to very thin paper, as recently required for light printing.

A technology is disclosed in which the low-temperature fixing property is improved by controlling frequency dependence of a synthesized curve obtained by frequency dispersion measurement of the viscoelasticity of the toner (see, for example, Japanese Patent Application Laid-open No. H04-199061). In addition, a technology is disclosed providing a wide fixing range by controlling the elastic modulus of toner (see, for example, Japanese Patent Application Laid-open No. H08-234480).

However, these technologies still have room for improvement, in consideration of dealing with high-speed image formation in light printing, and various types of paper. Also in the case where printed matter itself is dealt with as merchandise, there is room for improvement as a change in image quality results from deterioration in toner.

SUMMARY OF THE INVENTION

An object of the present invention is to provide a toner in which the aforementioned problems have been solved.

Another object of the present invention is to provide a toner which exhibits an excellent fixing property even during high-speed image formation, and can perform satisfactory image formation.

Still another object of the present invention is to provide a toner which is excellent its low-temperature fixing property and high-temperature offset resistance regardless of the types of paper.

A further object of the present invention is to provide a toner which can constantly provide high quality images even when used in a high humidity or low humidity environment, and does not generate image defects even after prolonged use.

The present invention provides a toner containing at least a binder resin and a colorant, wherein, in a master curve of the toner at a reference temperature of 150° C., a difference G' (1000)−G' (0.1) between a storage modulus G' (0.1) at a frequency of 0.1 Hz and a storage modulus G' (1000) at a frequency of 1000 Hz is within a range of from 0 to $2.5\times10^5$ Pa, where an activation energy Ea determined from a shift factor aT is within a range of from 50 to 130 kJ/mol.

Using the toner of the present invention, regardless of the types of paper, image formation with a excellent low-temperature fixing property and high-temperature offset resistance can be performed, and image formation can be carried out in which high quality images can be constantly provided even in a high humidity or low humidity environment, and image defects are reduced to a bare minimum even after extensive long term use.

The present inventors have investigated the constituent materials used in a toner, and found that a wide fixing range can be obtained, regardless of the types of paper, by controlling the frequency dependence of a storage modulus obtained by viscoelasticity measurement and an activation energy.

Further, the present inventors have found that a toner free from deterioration during prolonged use can be obtained by controlling the toner characteristics described above.

Furthermore, the present inventors have found that the viscoelastic characteristics and the activation energy of a toner can be easily controlled by controlling a crosslinked structure of a binder resin at a molecular level and a layered structure constituting a continuous structure of the toner in toner production.

The toner of the present invention is characterized in that, in a master curve of the toner at a reference temperature of 150° C., a difference G' (1000)−G' (0.1) between a storage modulus G' (0.1) at a frequency of 0.1 Hz and a storage modulus G' (1000) at a frequency of 1000 Hz is in a range of from 0 to $2.5\times10^5$ Pa.

The master curve obtained by frequency dispersion measurement in viscoelasticity measurement is known to generally indicate a crosslinking density in a substance having a crosslinked structure. If the frequency dependence is present in a storage modulus G' in the master curve, it is considered to be ascribable to a loose three-dimensional network structure composed of pseudo crosslinking sites resulting from entanglement at the molecular level. Stated differently, such substance is considered to have a low crosslinking density. On the other hand, if the frequency dependence is not present in the storage modulus G' in the master curve, it is considered to be ascribable to the three-dimensional network structure maintained by a dense network structure, indicating that the substance has a high crosslinking density. According to the investigation by the present inventors, it is clarified that the frequency dependence in the storage modulus is strongly correlated with the high-temperature offset resistance and the mechanical strength of the toner.

More specifically, if a difference, G' (1000)-G' (0.1), between a storage modulus G' (0.1) at a frequency of 0.1 Hz and a storage modulus G' (1000) at a frequency of 1000 Hz is more than $2.5\times10^5$ Pa, it is indicated that the crosslinked structure present in the toner is low in crosslinking density. In this case, the deformation of the crosslinked structure is promoted at high temperature to reduce the elasticity of the toner and to reduce the releasability from paper, thereby resulting in deterioration in the high-temperature offset resistance. Particularly in the case of toner fixation on thin paper such as drafting paper, the releasability from paper is significantly lowered to induce paper winding around a fixing roller. Also in the course of use over a prolonged period, the toner progressively deteriorates, thereby tending to induce changes in the image density and in the image quality over time and to generate fogging in a high temperature and high humidity environment.

Also in the toner of the present invention, it is very important, in addition to the aforementioned characteristics, that the activation energy Ea determined from a shift factor aT in the preparation of the master curve of the toner at a reference temperature of 150° C., is in a range of from 50 to 130 kJ/mol (preferably from 60 to 120 kJ/mol). The aforementioned activation energy Ea of the toner is considered to be a barrier against the deformation of a layered structure constituting a continuous structure in the network structure at the molecular level. It therefore indicates ease of thermal deformation of the toner, thus it can be said that the lower the activation energy, the better the low-temperature fixing property is. The activation energy Ea larger than 130 kJ/mol indicates that the toner is difficult to deform by heat. In this case, when image formation is carried out at a high speed, the fixing property becomes deficient even on plain paper. In the case where the activation energy Ea is smaller than 50 kJ/mol, the toner is easily deformed by heat, but is liable to stick to a fixing member or a developer carrying member. Also the toner deteriorates progressively in the course of use over a prolonged period, thereby causing changes over time in the image density and image quality.

As explained above, by satisfying both the frequency dependence of the storage modulus obtained by the viscoelasticity measurement of the toner and the activation energy, it is possible to achieve a wide fixing range for various types of paper ranging from thick paper having surface irregularities to thin paper such as drafting paper.

In the present invention, the master curve obtained from the frequency dispersion measurement and the activation energy are measured in the following manner. The master curve obtained from the frequency dispersion measurement corresponds to a curve which is obtained by shifting a viscoelasticity function measured at an arbitrary temperature T in a certain frequency range into the value at a reference temperature $T_0$ according to the time-temperature conversion law, and is therefore considered to coincide with values measured over a wide frequency range at the reference temperature $T_0$. In a viscoelastic substance such as a toner, it is difficult to measure the frequency dependence over a wide range of the storage modulus, so that the frequency dispersion measurement in the viscoelasticity measurement is very effective in evaluating toner frequency dependence over a wide range. A specific method for the measurement will be described below.

As a measuring instrument, a rheometer of a rotary plate type ARES (trade name, manufactured by TA Instruments Ltd.) is used.

A disc-shaped sample of a diameter of 25 mm and a thickness of 2.0±0.3 mm, prepared by press molding the toner using a tablet molding machine at 25° C., is used for measurement. The sample is set in a parallel plate and heated from the room temperature (25° C.) to 100° C. over 15 minutes to adjust the shape of the disc, and thereafter, the measurement is started.

It is important to set the sample in such a manner that normal force becomes initially zero. In the subsequent measurement, the influence of normal force is cancelled by selecting an automatic tension adjustment mode (Auto Tension Adjustment ON).

The measurement is carried out under the following conditions:

1. Using a parallel plate with a diameter of 25 mm.
2. Selecting frequencies of 0.1 Hz (Initial) and 100 Hz (Final).
3. Setting an initial applied strain at 0.1%.
4. Selecting a starting temperature of 100° C., an end temperature of 160° C., a temperature rising step of 10° C. and a soak time of 1 minute, then starting the measurement.
5. During the measurement, adopt an automatic tension adjustment mode (Auto Tension) with the following automatic tension adjusting conditions:
6. Setting the Auto Tension Direction at Compression.
7. Setting the Initial Static Force at 0 g, and the Auto Tension Sensitivity at 10.0 g.

Auto Tension is operable when the Sample Modulus is smaller than $1.0\times10^6$ Pa.

Based on the result of the storage modulus G' measured within the range of 0.1 to 100 Hz and the range of 100 to 160° C. under the above conditions, a master curve is prepared by the following method. In the present invention, since the fusion state of the toner on paper is important, the master curve is prepared taking as the reference temperature 150° C. at which the toner is in a fusion state. As for the shifting method, Two Dimensional Minimization is selected for optimization by vertical and lateral shifts, and as for the calculation method, Guess Mode is so selected as to preferentially calculate the gradient of the shift factor. In addition, the activation energy can be calculated from the Arrhenius plotting in which a logarithm of the shift factor aT obtained in the preparation of the master curve is plotted as ordinate and a reciprocal of the measurement temperature T is plotted as abscissa. The above analyses can be carried out using the ARES instrument.

The toner preferably has, on the master curve of the toner at the reference temperature of 150° C., a storage modulus G' (0.1) at a frequency of 0.1 Hz within a range of from $2\times10^3$ to $1.5\times10^4$ Pa. A storage modulus G' (0.1) less than $2\times10^3$ Pa is unable to retain sufficient elasticity at high temperature, whereby, in high-speed image formation, the high-temperature offset resistance is liable to deteriorate regardless of types of paper. Also the image quality tends to be lowered when the toner is used over a prolonged period. On the other hand, a storage modulus G' (0.1) more than $1.5\times10^4$ Pa increases the influence of elasticity at high temperature, thus the fixing property on thick paper having surface irregularities is liable to deteriorate.

Further, the toner preferably has, on the master curve of the toner at the reference temperature of 150° C., a storage modulus G' (1000) at a frequency of 1000 Hz within a range of from $8.0\times10^4$ to $3.0\times10^5$ Pa. A storage modulus G' (1000) less than $8.0\times10^4$ Pa is liable to reduce the mechanical strength of the toner, thereby resulting in deterioration in the image quality when the toner is used over a prolonged period. In particular, fog is liable to occur in the prolonged use in a high temperature and high humidity environment. A storage modulus G' (1000) more than $3.0\times10^5$ Pa is liable to result in the excessively high elasticity of the toner, whereby, in high-speed image formation, the low-temperature fixing property is deteriorated regardless of types of paper.

The binder resin preferably contains a THF-insoluble matter A that is not extracted by Soxhlet extraction with tetrahydrofuran (THF) for 16 hours, and the THF-insoluble matter A preferably contains a TOL-insoluble matter B that is not extracted by a Soxhlet extraction with toluene (TOL) for 16 hours. It is more preferable that the THF-insoluble matter A and the TOL-insoluble matter B satisfy a relation $0.10 \leqq B/A \leqq 0.60$, further preferably a relation $0.15 \leqq B/A \leqq 0.40$.

The solubility parameters of tetrahydrofuran and toluene are 18.6 $J^{0.5}m^{-1.5}$ and 18.2 $J^{0.5}m^{-1.5}$, respectively, which are almost the same, so that there is almost no difference between the amounts dissolved by salvation. Therefore, the reason that a soluble matter can be extracted by the Soxhlet extraction with toluene from the THF-insoluble matter which is not extracted by the Soxhlet extraction with tetrahydrofuran, is considered to be primarily due to a difference in extraction temperature between these solvents. Tetrahydrofuran has a boiling point of 66° C. while toluene has a boiling point of 110.6° C., and it is inferred that the molecular entanglement is partly unloosened by such temperature difference, thus an insoluble matter (tetrahydrofuran-insoluble matter) becomes a soluble matter (toluene-soluble matter).

A ratio B/A of the THF-insoluble matter A and the TOL-insoluble matter B less than 0.10 indicates that almost no insoluble matter in the TOL extraction is present and that the molecular entanglement is mostly unloosened at the boiling point of TOL. Because of the absence of a highly crosslinked component excellent in thermal stability, resistance to mechanical shear decreases, thus the toner is liable to deteriorate. As a result, it becomes difficult to maintain the image quality stably over a prolonged period. Also in the case of toner fixation on thin paper such as drafting paper, the releasability from the paper is significantly lowered to induce paper winding around a fixing roller. On the other hand, if a ratio B/A of the THF-insoluble matter A and the TOL-insoluble matter B is more than 0.60, it is indicated that there is almost no matter which becomes a soluble matter through molecular disentanglement resulting from the temperature rise of the solvent (difference in boiling temperature between THF and TOL). In such a case, the fixing property on plain paper is lowered.

It is preferable that the binder resin to be employed contains a polyester unit and a vinyl-type copolymerization unit. It is possible to easily design a crosslinked molecular structure having the aforementioned characteristics and a layered structure which is a continuous structure of the crosslinked molecular structure, by including a polyester unit generally excellent in low-temperature fixing property and a vinyl-type copolymerization unit which is excellent in high-temperature offset resistance and has high compatibility with a release agent, and controlling the physical properties of the two different binder resins, such as molecular weight distribution.

In order to obtain the desired effects, from the viewpoint of controlling the crosslinking sites, it is preferable that the binder resin is a hybrid resin in which the polyester unit and the vinyl-type copolymerization unit are chemically bonded.

A mixing ratio (based on mass) of the polyester unit and the vinyl-type copolymerization unit is preferably polyester unit/vinyl-type copolymerization unit=50/50 to 90/10, for the purpose of controlling the crosslinked structure in the molecular level. If the proportion of the polyester unit is less than 50 mass %, the frequency dependence of the master curve obtained from the frequency dispersion becomes large, thus the low-temperature fixing property required for various types of paper is not achieved. On the other hand, if the proportion of the polyester unit is more than 90 mass %, the frequency dependence of the master curve increases and the influence on the storability and the dispersion state of the release agent occurs, which is undesirable.

The binder resin preferably has, in a GPC analysis of the tetrahydrofuran (THF) soluble matter, a peak molecular weight Mp within a range of from 5,000 to 15,000, a weight-average molecular weight Mw of from 5,000 to 300,000, and a ratio Mw/Mn of the weight-average molecular weight Mw and the number-average molecular weight Mn within a range of from 5 to 50. A case of a sharp distribution with small Mp and Mw decreases the improving effect on the high-temperature offset resistance. In the case where Mp and Mw are large and the distribution is broad, the effect of improving the low-temperature fixing property is reduced.

The binder resin preferably has a glass transition temperature within a range of from 53 to 62° C., in consideration of the fixing property and the storability.

When subjected to extraction for 6 hours, the binder resin preferably contains a THF-insoluble matter within a range of from 15 to 50 mass %, more preferably from 15 to 45 mass %.

The THF-insoluble matter is a component effective in exhibiting satisfactory releasability from a heating member such as a fixing roller, and hence, when the toner is applied to a high-speed apparatus, it has an effect of reducing the toner offset amount to the heating member such as the fixing roller. With the amount of the THF-insoluble matter less than 15 mass %, it is difficult to obtain the aforementioned effect, and with the amount of the THF-insoluble matter more than 50 mass %, not only the fixing property but also the dispersibility of the raw materials into the toner deteriorates, whereby the chargeability is liable to become uneven.

As the binder resin, the resin described above may be used singly, or two or more types of binder resins having different softening points may be used in a mixture.

In the case of using two types of resins in a mixture, it is preferable to use either resin in a proportion of from 40 to 90 mass %, in consideration of the storability, the fixing property, the offset resistance and the highly durable developing property.

In the following, monomers used for forming the polyester unit contained in the binder resin will be explained. The polyester unit is a unit having a polyester skeleton, and refers to a polyester skeleton portion in a polyester resin or a hybrid resin.

Examples of an aliphatic dicarboxylic acid or a derivative thereof to be employed in the polyester unit include oxalic acid, malonic acid, maleic acid, fumaric acid, citraconic acid, itaconic acid, glutaconic acid, succinic acid, adipic acid, and derivatives thereof and acid anhydrides thereof, among which maleic acid, fumaric acid, alkenylsuccinic acid, and acid anhydrides thereof, and adipic acid are preferable in consideration of the controllability of the crosslinked structure.

Examples of an aliphatic diol include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, and 2-ethyl-1,3-hexanediol, among which ethylene glycol is preferred.

Examples of a tri or higher-polyvalent carboxylic acid or an anhydride thereof include 1,2,4-benzenetricarboxylic acid, 1,2, 4-cyclohexanetricarboxylic acid, 1,2,4-naphthalenetricarboxylic acid, pyromellitic acid, and acid anhydrides thereof and lower alkyl esters thereof. Examples of a tri or higher-polyhydric alcohol include 1,2, 3-propanetriol, trimethylolpropane, hexanetriol, and pentaerythritol. Among these, 1,2,4-benzenetricarboxylic acid and an anhydride thereof, and pentaerythritol are preferably in consideration of the controllability of the crosslinked structure.

Examples of another dihydric alcohol component include, in addition to the aliphatic diols mentioned above, hydrogenated bisphenol-A, bisphenol derivatives indicated by a following formula (i) and diols represented by a following formula (ii):

(i)

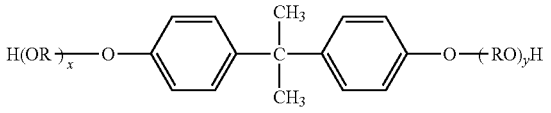

wherein R represents an ethylene or propylene group; x and y each independently represents an integer of 1 or larger, where an average value of x+y is from 2 to 10;

(ii)

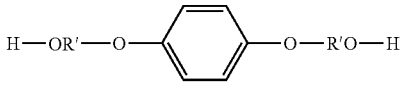

wherein R' represents —$CH_2CH_2$—, —$CH_2$—$CH(CH_3)$— or —$CH_2$—$C(CH_3)_2$—.

Examples of other dicarboxylic acids include, in addition to the aforementioned aliphatic dicarboxylic acids, aromatic dicarboxylic acids such as phthalic acid, terephthalic acid, isophthalic acid and phthalic anhydride, and derivatives thereof.

Examples of a vinyl-type monomer for forming the vinyl-type copolymerization unit contained in the binder resin include styrene-type monomers and acrylic acid-type monomers shown below. The vinyl-type copolymerization unit means a unit having a vinyl-type resin skeleton, and refers a vinyl-type copolymer or a vinyl-type resin skeleton portion in a hybrid resin.

Examples of the styrene-type monomer include styrene; and styrene derivatives such as o-methylstyrene, m-methylstyrene, p-methylstyrene, p-phenylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene and p-nitrostyrene.

Examples of the acrylic acid-type monomer include acrylic acid; and acrylic acid esters such as methyl acrylate, ethyl acrylate, propyl acrylate, n-butyl acrylate, isobutyl acrylate, n-octyl acrylate, dodecyl acrylate, 2-ethylhexyl acrylate, stearyl acrylate, 2-chloroethyl acrylate, and phenyl acrylate; α-methylene aliphatic monocarboxylic acid such as methacrylic acid; α-methylene aliphatic monocarboxylic acid esters such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, and phenyl methacrylate; and derivatives of acrylic acid or methacrylic acid such as dimethylaminoethyl methacrylate, diethylaminoethyl methacrylate, acrylonitrile, methacrylonitrile and acrylamide.

Examples of a monomer for the vinyl-type copolymerization unit include acrylate or methacrylate esters such as 2-hydroxyethyl acrylate, 2-hydroxyethyl methacrylate, and 2-hydroxypropyl methacrylate; and a monomer having a hydroxyl group such as 4-(1-hydroxy-1-methylbutyl)styrene, and 4-(1-hydroxy-methylhexyl)styrene.

With the vinyl-type copolymerization unit, various monomers capable of vinyl polymerization may be used in combination, according to necessity. Examples of such monomer include ethylenically unsaturated monoolefines such as ethylene, propylene, butylene and isobutylene; unsaturated polyenes such as butadiene and isoprene; halogenated vinyls such as vinyl chloride, vinylidene chloride, vinyl bromide and vinyl fluoride; vinyl esters such as vinyl acetate, vinyl propionate and vinyl benzoate; vinyl ethers such as vinyl methyl ether, vinyl ethyl ether and vinyl isobutyl ether; vinyl ketones such as vinyl methyl ketone, vinyl hexyl ketone and methyl isopropenyl ketone; N-vinyl compounds such as N-vinylpyrrole, N-vinylcarbazole, N-vinylindole and N-vinylpyrrolidone; vinylnaphthalenes; unsaturated dibasic acids such as maleic acid, citraconic acid, itaconic acid, alkenylsuccinic acid, fumaric acid and mesaconic acid; unsaturated dibasic acid anhydrides such as maleic anhydride, citraconic anhydride, itaconic anhydride and alkenylsuccinate anhydride; half esters of unsaturated dibasic acids such as methyl maleate half ester, ethyl maleate half ester, butyl maleate half ester, methyl citraconate half ester, ethyl citraconate half ester, butyl citraconate half ester, methyl itaconate half ester, methyl alkenylsucciniate half ester, methyl fumarate half ester, and methyl mesaconate half ester; unsaturated dibasic acid esters such as dimethyl maleate, and dimethyl fumarate; α,β-unsaturated acid anhydrides such as acrylic acid, methacrylic acid, crotonic acid and cinnamic acid; anhydrides of α,β-unsaturated acids and lower fatty acids; and monomers containing a carboxyl group such as alkenylmalonic acid, alkeylglutaric acid, alkenyladipic acid, and acid anhydrides thereof and monoesters thereof.

In the case of synthesizing a hybrid resin, it is preferable to employ, as the vinyl-type monomer, an unsaturated dibasic acid as an ambireactive material capable of carrying out both an addition polymerization and a polycondensation, and an anhydride or a half ester thereof, and particularly preferably maleic acid, maleic anhydride or fumaric acid. Among these, it is particularly preferable to use maleic acid and fumaric acid in combination that are different in reaction rate in a reaction with styrene, or to add fumaric acid or maleic acid dividedly in the initial stage and the later stage of the reaction, so that the crosslinked structure can be easily controlled. Specifically, it is preferable to synthesize the hybrid resin by incorporating fumaric acid (or maleic acid) in both the polyester monomer system and the vinyl-type monomer system, where the incorporation amount is particularly preferable in a molar ratio of from 1:3 to 3:1.

The aforementioned vinyl-type copolymerization unit may also be, if necessary, a polymer crosslinked with a crosslinking monomer as shown below. Examples of the crosslinking monomer include aromatic divinyl compounds, diacrylate compounds bonded by an alkyl chain, diacrylate compounds bonded by a chain containing an ether bond, diacrylate compound bonded by a chain containing an aromatic group and an ether bond, polyester-type diacrylates, and polyfunctional crosslinking agents.

Examples of the aromatic divinyl compound include divinylbenzene, and divinylnaphthalene.

Examples of the diacrylate compound bonded by an alkyl chain include ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and compounds obtained by replacing acrylate in these compounds with methacrylate.

Examples of the diacrylate compound bonded by an alkyl chain containing an ether bond include diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and compounds obtained by replacing acrylate in these compounds with methacrylate.

Examples of the diacrylate compound bonded by a chain containing an aromatic group and an ether bond include polyoxyethylene (2)-2,2-bis(4-hydroxyphenyl)propane diacrylate, polyoxyethylene (4)-2,2-bis(4-hydroxyphenyl)propane diacrylate, and compounds obtained by replacing acrylate in these compounds with methacrylate. Examples of polyester-type diacrylate include a compound MANDA (trade name, available from Nippon Kayaku Co.).

Examples of the polyfunctional crosslinking agent include pentaerythritol triacrylate, trimethylolethane triacrylate, trimethylolpropane triacrylate, tetramethylolmethane tetraacrylate, oligoester acrylate, and compounds obtained by replacing acrylate in these compounds with methacrylate; triallyl cyanurate, and triallyl trimellitate.

These crosslinking monomers may be used in an amount of from 0.01 to 10 parts by mass (more preferably from 0.03 to 5 parts by mass) with respect to 100 parts by mass of other monomer components. Among these crosslinking monomers, the aromatic divinyl compound (particularly divinylbenzene) or the diacrylate compound bonded by a chain containing an aromatic group and an ether bond is preferably used in consideration of the fixing property and the offset resistance.

The vinyl-type copolymerization unit may also be a resin produced utilizing a polymerization initiator. Such polymerization initiator is preferably employed, in consideration of efficiency, in an amount of from 0.05 to 10 parts by mass with respect to 100 parts by mass of the monomer.

Examples of the polymerization initiator include ketone peroxides such as 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl 2,2'-azobisisobutyrate, 1,1'-azobis(1-cyclohexanecarbonitrile), 2-carbamoylazoisobutyronitrile, 2,2'-azobis(2,4,4-trimethylpentane), 2-phenylazo-2,4-dimethyl-4-methoxyvaleronitrile, 2,2'-azobis(2-methylpropane), methyl ethyl ketone peroxide, acetylacetone peroxide, and cyclohexanone peroxide; 2,2-bis(t-butylperoxy)butane, t-butyl hydroperoxide, cumene hydroperoxide, 1,1,3,3-tetramethylbutyl hydroperoxide, di-t-butyl peroxide, t-butylcumyl peroxide, dicumyl peroxide, α,α'-bis(t-butylperoxyisopropyl)benzene, isobutyl peroxide, octanoyl peroxide, decanoyl peroxide, lauroyl peroxide, 3,5,5-trimethylhexanoyl peroxide, benzoyl peroxide, m-toluoyl peroxide, diisopropyl peroxydicarbonate, di-2-ethylhexyl peroxydicarbonate, di-n-propyl peroxydicarbonate, di-2-ethoxyethyl peroxycarbonate, dimethoxyisopropyl peroxydicarbonate, di(3-methyl-3-methoxybutyl) peroxycarbonate, acetylcyclohexylsulfonyl peroxide, t-butyl peroxyacetate, t-butyl peroxyisobutyrate, t-butyl peroxyneodecanoate, t-butylperoxy-2-ethyl hexanoate, t-butyl peroxylaurate, t-butyl peroxybenzoate, t-butyl peroxyisopropylcarbonate, di-t-butyl peroxyisophthalate, t-butyl peroxyallylcarbonate, t-amyl peroxy-2-ethylhexanoate, di-t-butyl peroxyhexahydroterephthalate, and di-t-butyl peroxyazelate.

The hybrid resin more preferably usable as the binder resin is a resin in which the polyester unit and the vinyl-type copolymerization unit are chemically bonded directly or indirectly. Such hybrid resin can be obtained by reacting a raw material monomer of the polyester unit and a raw material monomer of the vinyl-type copolymerization unit either simultaneously or in succession. In order to obtain a desired crosslinked structure in the hybrid resin, it is preferable, as described above, to use fumaric acid and maleic acid which are different in reactivity in combination, or to add fumaric acid or maleic acid in a divided manner in the initial stage and in the later stage of the reaction. Also in order to suppress gelation resulting from the ambireactive substance and to control the crosslinked structure, polycondensation is preferably performed at relatively low temperature, preferably at a reaction temperature of from 200 to 220° C.

The toner may contain a release agent having a melting point within a range of from 60 to 120° C. (preferably from 70 to 115° C.) as defined by the peak temperature of a maximum endothermic peak at a temperature elevation in a measurement with a differential scanning calorimeter (DSC). When the melting point is lower than 60° C., the viscosity of the toner decreases and the releasability deteriorates, thereby causing contamination on the developing member and the cleaning member in continuous running. On the other hand, when the melting point is higher than 120° C., it is difficult to obtain the desired low-temperature fixing property.

The release agent is preferably added in an amount of from 1 to 20 parts by mass with respect to 100 parts by mass of the binder resin. The addition amount less than 1 part by mass is unable to exhibit a sufficient releasing effect. On the other hand, when the addition amount is more than 20 parts by mass, the release agent is difficult to disperse, tending to bring about problems such as toner sticking to an image bearing member (a photosensitive member), contamination on the developing member surface and the cleaning member surface, and deterioration in toner images.

Examples of the release agent include aliphatic hydrocarbon waxes such as low molecular weight polyethylene, low molecular weight polypropylene, microcrystalline wax, paraffin wax and Fischer-Tropsch wax; oxides of aliphatic hydrocarbon waxes such as polyethylene oxide wax; block copolymers of such aliphatic hydrocarbon waxes; ester waxes such as carnauba wax, montanic acid ester wax and fatty acid ester wax; and partially or totally deacidified fatty acid esters such as deacidified carnauba wax. Further examples include saturated linear fatty acids such as palmitic acid, stearic acid, montanic acid and a long-chain alkyl carboxylic acid having an even longer alkyl group; unsaturated fatty acids such as brassidic acid, eleostearic acid, and valinaric acid; saturated alcohols such as stearyl alcohol, aralkyl alcohol, behenyl alcohol, carnaubyl alcohol, ceryl alcohol, melissyl alcohol, and a long-chain alkyl alcohol having an even longer alkyl group; polyhydric alcohols such as sorbitol; fatty acid metal salts (generally called metal soaps) such as calcium stearate, calcium laurate, zinc stearate, and magnesium stearate; waxes obtained by grafting styrene or acrylic acid to an aliphatic hydrocarbon wax; partial esters of a fatty acid and a polyhydric alcohol such as behenic acid monoglyceride; methyl ester compounds having a hydroxyl group obtained by hydrogenation of vegetable oils and fats; and long-chain alkyl alcohols or long-chain alkylcarboxylic acids containing 12 or more carbon atoms.

A release agent particularly preferably usable is the aliphatic hydrocarbon wax. Examples of such aliphatic hydrocarbon wax include alkylene polymers of a low molecular weight formed by radical polymerization of alkylene under high pressure or under low pressure utilizing a Ziegler catalyst; alkylene polymers formed by pyrolysis of a high molecular weight alkylene polymer; synthetic hydrocarbon waxes obtained from distillation residue of hydrocarbons obtained by Aage process from a synthetic gas containing carbon monoxide and hydrogen, and synthetic hydrocarbon waxes obtained by hydrogenation thereof; and substances obtained by fractionating these aliphatic hydrocarbon waxes by a press perspiration method, a solvent method, a vacuum distillation method or a fractional crystallization method.

Examples of the hydrocarbon constituting the basis of the aliphatic hydrocarbon wax include hydrocarbons synthesized by a reaction of carbon monoxide and hydrogen utilizing a metal oxide catalyst (normally composed of two or more elements) (for example, hydrocarbon compounds synthesized by a synthol process or a Hydrocol process (utilizing a fluid catalyst bed)); hydrocarbons containing up to several hundred carbon atoms obtained by an Arge process (utilizing a fixed catalyst bed); and hydrocarbons obtained by polymerizing an alkylene such as ethylene by the use of a Ziegler catalyst. Among these hydrocarbons, in the present invention, saturated long linear chain hydrocarbons whose branched chains are less and small is preferable, and hydrocarbons synthesized by a method not relying on alkylene polymerization is particularly preferable from the viewpoint of molecular weight distribution.

Specific examples of the usable release agent include VISCOL (registered trade name) 330-P, 550-P, 660-P, and TS-200 (available from Sanyo Chemical Industries Ltd.); Hi-wax 400P, 200P, 100P, 410P, 420P, 320P, 220P, 210P and 110P (available from Mitsui Chemical Co.); SAZOL H1, H2, C80, C105 and C77 (available from Schuman Sazol Co.); HNP-1, HNP-3, HNP-9, HNP-10, HNP-11 and HNP-12 (available from Nippon Seiro Co.); UNILIN (registered trade name) 350, 425, 550, 700, UNICID (registered trade name) 350, 425, 550 and 700 (available from Toyo Petrolite Co.); Japan tallow, bee wax, rice wax, candelilla wax and carnauba wax (available from Cerarica Noda Co.).

The release agent may be added at the time of melt kneading in the toner manufacture or at the time of producing the binder resin, and the timing of the addition may be suitably selected from known methods. These release agents may be used singly or in combination.

The present invention is applicable to a magnetic toner and a non-magnetic toner, but preferably to a magnetic toner in consideration of the stability in continuous running in a high-speed equipment.

When used as a magnetic toner, examples of a magnetic material to be used include iron oxides such as magnetite, maghemite, ferrite and magnetic iron oxides containing another metal oxide; metals such as Fe, Co and Ni, and alloys of such metal and another metal such as Al, Co, Pb, Mg, Ni, Sn, Zn, Sb, Be, Bf, Cd, Ca, Mn, Se, Ti, W or V, and mixtures thereof. There are already known triiron tetroxide ($Fe_3O_4$), diiron trioxide ($\gamma$-$Fe_2O_3$), iron zinc oxide ($ZnFe_2O_4$), iron yttrium oxide ($Y_3Fe_5O_{12}$), iron cadmium oxide ($Cd_3Fe_2O_4$), iron gadolinium oxide ($Gd_3Fe_5O_{12}$), iron copper oxide ($CuFe_2O_4$), iron lead oxide ($PbFe_{12}O_{19}$), iron nickel oxide ($NiFe_2O_4$), iron neodymium oxide ($NdFe_2O_3$), iron barium oxide ($BaFe_{12}O_{19}$), iron magnesium oxide ($MgFe_2O_4$), iron manganese oxide ($MnFe_2O_4$), iron lanthanum oxide ($LaFeO_3$), iron powder, cobalt powder and nickel powder. A particularly preferable magnetic material is a fine powder of triiron tetroxide or diiron trioxide. The aforementioned magnetic materials may be selected and used singly or in a mixture of two or more kinds.

In regard to the magnetic characteristics at the application of 795.8 kA/m, these magnetic materials preferably have a coercive force (Hc) of from 1.6 to 12.0 kA/m, a magnetization ($\sigma_{10}$ k) of from 50 to 200 $Am^2/kg$ (preferably from 50 to 100 $Am^2/kg$), and a residual magnetization ($\sigma_r$) of from 2 to 20 $Am^2/kg$. The magnetic characteristics of the magnetic material can be measured under conditions of 25° C. and an external magnetic field of 769 kA/m using a vibration magnetometer such as VSM P-1-10 (manufactured by Toei Kogyo Co.). The magnetic material is preferably added in an amount of 10 to 200 parts by mass with respect to 100 parts by mass of the binder resin.

When used as a non-magnetic toner, the following pigment or dye may be used as colorant.

The colorant may be constituted of one or more of carbon black and other known pigments and dyes.

Examples of the dye include C.I. Direct Red 1, C.I. Direct Red 4, C.I. Acid Red 1, C.I. Basic Red 1, C.I. Mordant Red 30, C.I. Direct Blue 1, C.I. Direct Blue 2, C.I. Acid Blue 9, C.I. Acid Blue 15, C.I. Basic Blue 3, C.I. Basic Blue 5, C.I. Mordant Blue 7, C.I. Direct Green 6, C.I. Basic Green 4, and C.I. Basic Green 6. Examples of the pigment include lead yellow, cadmium yellow, mineral fast yellow, nable yellow, naphthol yellow S, Hanza yellow G, permanent yellow NCG, Tartrazine Lake, red lead yellow, molybdenum orange, permanent orange GRT, pyrrazolone orange, benzidine orange G, cadmium red, permanent red 4R, watching red calcium salt, eosine lake, brilliant carmine 3B, manganese violet, fast violet B, methyl violet lake, Prussian blue, cobalt blue, alkali blue lake, Victoria blue lake, phthalocyanine blue, fast sky blue, indanthrene blue BC, chromium green, chromium oxide, pigment green B, malachite green lake, and final yellow green G.

In the case of using the toner as a toner for full-color image formation, the following colorants may be used. Examples of a magenta colorant include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207, 209, C.I. Pigment Violet 19, C.I. Vat Red 1, 2, 10, 13, 15, 23, 29 and 35.

Such magenta coloring pigment may be used singly, but it is preferable to use a dye and a pigment in combination for improving color definition in consideration of the image quality of full-color images. Examples of a magenta coloring dye include oil-soluble dyes such as C.I. Solvent Red 1, 3, 8, 23, 24, 25, 27, 30, 49, 81, 82, 83, 84, 100, 109, 121, C.I. Disperse Red 9, C.I. Solvent Violet 8, 13, 14, 21, 27, and C.I. Disperse Violet 1; and basic dyes such as C.I. Basic Red 1, 2, 9, 12, 13, 14, 15, 17, 18, 22, 23, 24, 27, 29, 32, 34, 35, 36, 37, 38, 39, 40, C.I. Basic Violet 1, 3, 7, 10, 14, 15, 21, 25, 26, 27 and 28.

Examples of a cyan coloring pigment include C.I. Pigment Blue 2, 3, 15, 16, 17, C.I. Vat Blue 6, C.I. Acid Blue 45 and a copper phthalocyanine pigment formed by substituting a phthalocyanine skeleton having the following structure with 1 to 5 phthalimidemethyl groups:

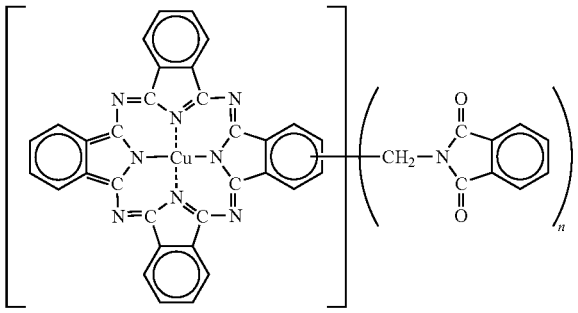

n = 1~5

Examples of a yellow coloring pigment include C.I. Pigment Yellow 1, 2, 3, 4, 5, 6, 7, 10, 11, 12, 13, 14, 15, 16, 17, 23, 35, 73, 83, C.I. Vat Yellow 1, 3 and 20.

The colorant is preferably used in an amount of from 0.1 to 60 parts by mass, more preferably from 0.5 to 50 parts by mass, with respect to 100 parts by mass of the resin component.

In the toner of the present invention, a charge control agent may be used for stabilizing the charging property. The charge control agent, though variable depending on a type thereof and physical properties of other materials constituting the toner particle, is preferably contained in an amount of from 0.1 to 10 parts by mass, more preferably from 0.1 to 5 parts by mass, with respect to 100 parts by mass of the binder resin. Such charge control agents are known to include one controlling toner to be negatively chargeable and one controlling toner to be positively chargeable, and may be used singly or in a mixture of two or more kinds, according to the type and application of toner.

For controlling toner to be negatively chargeable, for example, an organometallic complex or a chelate compound is effective, and examples thereof include monoazo metal complexes; acetylacetone metal complexes; metal complexes or metal salts of aromatic hydroxycarboxylic acids or aromatic dicarboxylic acids. Other examples for controlling toner to be negatively chargeable include aromatic mono- or poly-carboxylic acids, metal salts and anhydrides thereof; phenol derivatives such as esters and bisphenol.

For controlling toner to be positively chargeable, examples of the agent include denatured products of nigrosin and fatty acid metal salts; quaternary ammonium salts such as tributylbenzylammonium 1-hydroxy-4-naphthosulfonate and tetrabutylammonium tetrafluoroborate, and onium salt such as posphonium salts as analogs thereof, and lake pigments thereof; triphenylmethane dyes and lake pigments thereof (a lake-forming agent is, for example, phosphotungstic acid, phosphomolybdic acid, phototungstomolybdic acid, tannic acid, lauric acid, gallic acid, ferricyanic acid, ferrocyan compound, etc.); metal salts of higher fatty acids; diorganotin oxides such as dibutyltin oxide, dioctyltin oxide and dicyclohexyltin oxide; and diorganotin borates such as dibutyltin borate, dioctyltin borate and dicyclohexyltin borate. In the present invention, these materials may be used singly or in a combination of two or more kinds. Among these, the charge control agent for controlling toner to be positively chargeable is particularly preferably a nigrosin compound or a quaternary ammonium salt.

As specific examples of usable materials, the following may be cited: Spilon Black TRH, T-77, T-95 (manufactured by Hodogaya Chemical Co.), BONTRON (registered trade name) S-34, S-44, S-54, E-84, E-88, and E-89 (manufactured by Orient Chemical Co.), and preferred examples for positive charging include TP-302, TP-415 (manufactured by Hodogaya Chemical Co.), BONTRON (registered trade name) N-01, N-04, N-07, P-51 (manufactured by Orient Chemical Co.), and Copy Blue PR (manufactured by Clariant Ltd.).

A charge control resin may also be used, and may be used in combination with the charge control agent above.

In the present invention, the toner may have a positive or negative charging polarity, but is preferably a negatively chargeable toner, because the polyester resin as a binder resin has a strong negative chargeability.

In the toner of the present invention, an inorganic fine powder may be used as a fluidity improving agent. Such fluidity improving agent may be any material which is externally added to toner particles and is capable of improving the fluidity of the toner particles. Examples thereof include fine fluorinated resin powder such as fine vinylidene fluoride powder or fine polytetrafluoroethylene powder; fine silica powder such as wet process silica or dry process silica; and processed silica formed by surface-treating these silica materials with a silane coupling agent, a titanium coupling agent or silicone oil. A preferred fluidity improving agent is a fine powder formed by vapor phase oxidation of a silicon halide compound known as dry process silica or fumed silica and produced by conventionally known techniques. For example, the pyrolytic oxidation reaction of silicon tetrachloride gas in oxygen and hydrogen is utilized, and the basic reaction formula is as follows:

$$SiCL_4+2H_2+O_2 \rightarrow SiO_2+4HCl$$

In this process, it is also possible to obtain fine composite powders composed of silica and another metal oxide by using another metal halide such as aluminum chloride or titanium chloride in combination with silicon halide, and such materials as well are included in the "silica" herein. The fine silica powder preferably has a particle size in a range of from 0.001 to 2 μm, particularly preferably from 0.002 to 0.2 μm, in terms of average primary particle size.

Commercially available fine silica powders produced by vapor phase oxidation of silicon halide compounds are available under the following trade names:

AEROSIL (Nippon Aerosil Co.)
130
200
300
380
TT600
MOX170
MOX80
COK84
Ca—O-Sil (CABOT Co.)
M-5
MS-7
MS-75
HS-5
EH-5
Wacker HDK N 20 (Wacker-Chemie GNBH)
V15
N20E
T30
T40
D-C Fine Silica (Dow-Corning Co.)
Fransol (Francil Inc.)

It is further preferable to use a fine processed silica powder obtained by subjecting to hydrophobic treatment the fine silica powder produced by vapor phase oxidation of the silicon halide. The fine processed silica powder particularly preferably has a hydrophobicity within a range of from 30 to 80 as measured by a methanol titration test.

A method for making fine silica powder hydrophobic can be performed by chemical treatment with an organosilicon compound capable of reacting with, or physically adsorbing to, the fine silica powder. In a preferred method, a silica powder produced by vapor phase oxidation of silicon halide is treated with an organic silicon compound. Examples of such organosilicon compound include hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptan, trimethylsilylmercaptan, triorganosilyl acrylate, vinyldimethylacetoxysilane, dimethylethoxysilane, dimethyldimethoxysilane, diphenyldiethoxysilane, 1-hexamethyldisiloxane, 1,3-divinyltetramethyldisiloxane, 1,3-diphenyltetramethyldisiloxane and dimethylpolysiloxane having 2 to 12 siloxane units per molecule and having a hydroxyl group bonded to Si in each of terminal units. These compounds may be used singly or in a combination of two or more kinds.

Such inorganic fine powder may be treated with silicone oil, or may be treated in combination with the above hydrophobic treatment.

The silicone oil preferably has a viscosity of from 30 to 1000 $mm^2/s$ at 25° C., and is particularly preferably, for example, dimethylsilicone oil, methylphenylsilicone oil, a-methylstyrene-denatured silicone oil, chlorophenylsilicone oil, or fluorine-denatured silicon oil.

For the silicon oil treatment, there may be employed, for example, a method of directly mixing fine silica powder treated with a silane coupling agent, with silicone oil by a mixer such as a Henschel mixer; a method of spraying silicone oil onto fine silica powder as a base; or a method of dissolving or dispersing silicone oil in a suitable solvent, then mixing fine silica powder and eliminating the solvent. It is more preferable that the silicone oil-treated silica, after the treatment with silicone oil, is heated at 200° C. or above (more preferably 250° C. or above) in an inert gas, thereby stabilizing the surface coating.

Nitrogen-containing silane coupling agents, such as aminopropyltrimethoxysilane, aminopropyltriethoxysilane, dimethylaminopropyltrimethoxysilane, diethylaminopropyltrimethoxysilane, dipropylaminopropyltrimethoxysilane, dibutylaminopropyltrimethoxysilane, monobutylaminopropyltrimethoxysilane, dioctylaminopropyldimethoxysilane, dibutylaminopropyldimethoxysilane, dibutylaminopropylmonomethoxysilane, dimethylaminophenyltriethoxysilane, trimethoxysilyl-γ-propylphenylamine, and trimethoxysilyl-γ-propylbenzylamine, may be used singly or in a combination of two or more kinds. A preferred silane coupling agent is hexamethyldisilazane (HMDS)

In the present invention, it is preferable to treat silica by the following method: a method of treating silica with a coupling agent and then treating it with silicone oil, or by a method of treating silica with a coupling agent and silicone oil at the same time.

The fluidity improving agent provides satisfactory results when having a specific surface area of 30 $m^2/g$ or higher, preferably 50 $m^2/g$ or higher, as measured by nitrogen adsorption in the BET method. The fluidity improving agent is used in an amount of from 0.01 to 8 parts by mass, preferably from 0.1 to 4 parts by mass, with respect to 100 parts by mass of toner base particles having no external additive.

In addition, external additives other than the fluidity improving agent may be added to the toner as needed.

Examples of such additives include fine resin particles and inorganic fine particles, serving as a charging auxiliary agent, a conductivity providing agent, a fluidity providing agent, an anti-caking agent, a release agent, a lubricant, or an abrasive. Examples of such particles include a lubricant such as Teflon (registered trade name), zinc stearate, or polyvinylidene fluoride, among which polyvinylidene fluoride is preferred; an abrasive such as cerium oxide, silicon carbide or strontium titanate, among which strontium titanate is preferred; and a fluidity providing agent such as titanium oxide, or aluminum oxide, among which one having hydrophobicity is preferred. Also there may be employed an anti-caking agent or a conductivity providing agent such as carbon black, zinc oxide, antimony oxide or tin oxide, and besides fine particles with an opposite polarity may be used in a small amount as a developability improving agent.

The fine resin particles, inorganic fine powder or hydrophobic inorganic fine powder to be mixed with the toner base particles, is preferably employed in an amount of from 0.1 to 5 parts by mass with respect to 100 parts by mass of the toner base particles.

The toner of the present invention preferably has a weight-average particle size of from 3 to 9 μm, in consideration of the image density and the image resolution.

In the following, methods for measuring the physical properties involved with the present invention will be shown.

[Measurement of THF-Insoluble Matter]

About 1.0 g of the toner is weighed (as W1 g), then placed in a cylindrical filter paper (for example, No. 86R having a size of 28×100 mm, manufactured by Toyo Filter Paper Co.), and is subjected to extraction by means of a Soxhlet extractor for 16 hours using 200 ml of THF as the solvent. The extraction is carried out in such a refluxing rate that an extraction cycle with the solvent is carried out once every about 4 to 5 minutes. After the extraction, the cylindrical filter paper is taken out and dried in vacuum at 40° C. for 8 hours, and the extraction residue is weighed (W2 g).

Then an incineration residual ash in the toner is determined (as W3 g). In a precisely weighed 30-ml porcelain crucible, a sample of about 2 g is placed and precisely weighed to determine a precise mass (Wa g) of the sample. The crucible is heated in an electric oven for 3 hours at about 900° C., then left standing to cool in the electric oven and for 1 hour or longer in a desiccator at normal temperature, and the crucible containing the incineration residual ash is precisely weighed. The mass of the crucible measured in advance is subtracted from the measured value, to determine the mass of the incineration residual ash (Wb g). Thus, the incineration residual ash content (mass %) in the sample can be determined:

$$\text{Incineration residual ash content} = Wb/Wa$$

From the incineration residual ash content, the mass (W3 g) of the incineration residual ash in the sample is determined:

$$\text{Mass of incineration residual ash } (W3\text{ g}) = W1 \times (Wb/Wa)$$

The THF-insoluble matter is determined from the following equation:

$$\text{THF-insoluble matter } A\ (\%) = \{(W2 - W3)/(W1 - W3)\} \times 100$$

The THF-insoluble matter of a sample containing no components other than the resin such as the binder resin, can be determined by extracting the predetermined weighed amount (W1 g) of the sample in the same procedure as in the above, precisely weighing the residue (W2 g) and making a calculation according to the following formula:

$$\text{THF-insoluble matter } A\ (\%)=(W2/W1)\times 100$$

In the above measuring method, components carbonized and lost (scattered) in heating the crucible containing the sample at about 900° C. is regarded as a component of the binder resin in the toner. Since the toner also contains components that are lost (scattered) by heating other in addition to the binder resin, this concept is not exact in a strict sense, but an error is small and is negligible.

[Measurement of TOL-Insoluble Matter]

The insoluble matter obtained by re-extracting the THF-insoluble matter A with toluene is measured in the following manner. At first, the cylindrical filter paper containing the extraction residue (W2 g) resulting from the extraction with THF, is subjected again to extraction by means of a Soxhlet extractor for 16 hours using 200 ml of toluene. The extraction is carried out in such a refluxing rate that an extraction cycle with the solvent is carried out once every about 4 to 5 minutes. After the extraction, the cylindrical filter paper is taken out and dried in vacuum at 40° C. for 8 hours, and the extraction residue is weighed (W4 g).

The TOL-insoluble matter is determined from the following equation:

$$\text{TOL-insoluble matter } B\ (\%)=\{(W4-W3)/(W1-W3)\}\times 100$$

[Measurement of Molecular Weight Distribution by GPC]

A column is stabilized in a heat chamber at 40° C., and THF as a solvent is flown at a flow rate of 1 ml/min in the column at this temperature, and about 100 μl of a sample solution is injected in THF, thus measurement is performed. In the measurement of the molecular weight of the sample, the molecular weight distribution of the sample is calculated from the relationship between logarithmic values on an analytical curve prepared from several standard samples of monodisperse polystyrene, and counted values. As standard polystyrene samples for preparing the analytical curve, there may be used, for example, those available from Tosoh Corp. or Showa Denko K.K. and having molecular weights of about from $10^2$ to $10^7$, and it is adequate to use standard polystyrene samples of at least 10 types. For the detection, an RI (refractive index) detector is used. For the column, it is preferable to use a combination of a plurality of commercially available polystyrene gel columns, and examples of the combination of columns include a combination of Shodex GPC KF-801, 802, 803, 804, 805, 806, 807 and 800P available from Showa Denko K.K. and a combination of TSKgel G1000H ($H_{XL}$), G2000H ($H_{XL}$), G3000H ($H_{XL}$), G4000H ($H_{XL}$), G5000H ($H_{XL}$), G6000H ($H_{XL}$), G7000H ($H_{XL}$) and TSK guard column available from Tosoh Corp.

The sample is prepared in the following manner.

A toner is placed in THF, and left standing for several hours at 25° C., then thoroughly mixed with THF by sufficient shaking (until aggregates of the sample vanish), and is left standing again for further 12 hours or longer. In this operation, a time for which the sample is left standing in THF is so set as to be 24 hours. Thereafter, the mixture is passed through a sample processing filter (having a pore size of from 0.2 to 0.5 μm, for example Maeshori Disc H-25-2 (manufactured by Tosoh Corp.)) to prepare a GPC sample. A concentration of the sample is so regulated that the resin component is 0.5 to 5.0 mg/ml. A main peak in the molecular weight distribution obtained by measuring the sample solution after left standing for 24 hours at 25° C., is defined as Mp.

[Particle Size Distribution of Magnetic Toner]

The particle size distribution of the magnetic toner may be measured by various methods, but in the present invention, is measured by means of a Coulter counter. As the measuring instrument, Coulter Multisizer IIE (manufactured by Coulter Inc.) is used. As an electrolyte, an approximately 1% aqueous solution of NaCl is prepared using first class grade sodium chloride. For example, ISOTRON (R)-II (manufactured by Coulter Scientific Japan Co.) is usable for this purpose. As for the measurement, in 100 to 150 ml of the electrolytic aqueous solution, a surfactant (preferably sodium dodecylbenzenesulfonate) is added in an amount of from 0.1 to 5 ml as a dispersant, and the sample for measurement is added in an amount of from 2 to 20 mg. The electrolytic solution in which the sample is suspended is dispersed for about 1 to 3 minutes by an ultrasonic dispersing device, and then the measurement is carried out using the aforementioned measuring instrument at a 100 μm aperture to find the volume and number of toner particles, thereby calculating the volume distribution and number distribution, and determining the weight-average particle size (D4).

[Measurement of Glass Transition Temperature (Tg) of Resin and Melting Point of Wax]

Measuring instrument: Differential scanning calorimeter (DSC), MDSC-2920, DSC-Q1000 (manufactured by TA Instruments Inc.)

Measuring method: According to ASTM D3418-82

Measurement environment: Under normal temperature and normal humidity

A sample to be measured is precisely weighed in an amount of from 2 to 10 mg, preferably 3 mg, and placed in an aluminum pan, then the measurement is carried out in a measuring temperature range of from 30 to 200° C., using an empty aluminum pan as reference. The temperature is elevated to 200° C. at a temperature increasing rate of 10° C./min, then lowered to 20° C. at a temperature decreasing rate of 10° C., and again elevated to 200° C. at a temperature increasing rate of 10° C./min, and a DSC curve obtained during the course of the second temperature elevating process is used for analysis.

For the glass transition temperature (Tg), the value obtained by analysis according to the midpoint method on the obtained DSC curve is used. The melting point of wax is defined as the peak temperature of the endothermic main peak on the resulting DSC curve.

In the following, a method for producing the toner will be explained. The binder resin, colorant and other additives are sufficiently mixed using a mixing machine such as a Henschel mixer or a ball mill, and melt-kneaded using a thermal kneader such as a heat roll, a kneader or an extruder, then cooled to solidify followed by grinding and classification, and if necessary, sufficiently mixed with desired additives by means of a mixer such as a Henschel mixer, thereby obtaining the toner of the present invention. In order to obtain the toner having the desired viscoelastic characteristics and the desired activation energy value, it is important not only to control the crosslinked structure of respective molecules but also to control the structure of resin as the mass of molecules. According to the investigation by the present inventors, it is clarified that the above structural control can be accomplished by controlling the kneading state of the resin composition in the heat kneading step. Specifically, it is preferable that the resin temperature is adjusted to 130° C. to 160° C. in order to perform heat kneading under relatively high shearing force, and the melt kneading is carried out in a state that a vent hole is opened in order to reduce the pressure generated in the kneading.

Examples of the mixer include Henschel mixer (manufactured by Mitsui Mining Co.); Super Mixer (manufactured by Kawata Co.); Ribbocone (manufactured by Okawara Mfg. Co.); Nauter Mixer, Turburizer, Cyclomix (manufactured by Hosokawa Micron Co.); Spiral Pin Mixer (manufactured by Taiheiyo Kiko Co.); and Loedige Mixer (manufactured by Matsubo Corp.). Examples of the kneader include KRC Kneader (manufactured by Kurimoto Kekko Ltd.); Buss-Co-Kneader (manufactured by Buss Corp.); TEM extruder (manufactured by Toshiba Machine Co.); TEX two-shaft kneader (manufactured by Nippon Steel Co.); PCM kneader (manufactured by Ikegai Tekko Co.); three-roll mill, mixing roll mill, kneader (manufactured by Inoue Mfg. Co.); Kneadex (manufactured by Mitsui Mining Co.); MS-type pressure kneader, Kneader-ruder (manufactured by Moriyama Mfg. Co.); and Banbury mixer (manufactured by Kobe Steel Co.). Examples of the grinding machine include Counter Jet Mill, Micron Jet, Inomizer (manufactured by Hosokawa Micron Co.); IDS-type Mill, PJM Jet pulverizer (manufactured by Nippon Pneumatic Industries Ltd.); Cross Jet Mill (manufactured by Kurimoto Tekko Co.); Ulmax (Nisshin Engineering Co.); SK Jet-O-Mill (manufactured by Seishin Enterprise Co.); Cryptron (Kawasaki Heavy Industries, Co.); Turbo Mill (manufactured by Turbo Kogyo Co.); and Super Rotor (manufactured by Nisso Engineering Co.). Examples of the classifier include Classiel, Micron classifier, Spedic classifier (manufactured by Seishin Enterprise Co.); Trbo classifier (manufactured by Nisshin Engineering Co.); Micron Separator, Turboplex (manufactured by ATP); TSP separator (manufactured by Hosokawa Micron Co.); Elbow Jet (manufactured by Nittetsu Mining Co.); Dispersion Separator (manufactured by Nippon Pneumatic Industries Co.); and YM Microcut (manufactured by Yasukawa Trading Co.). Examples of a sieving apparatus for sieving off coarse particles include Ultrasonic (manufactured by Koei Sangyo Co.); Resonasieve, Gyroshifter (manufactured by Tokuju Kosakusho Co.); Vibrasonic system (manufactured by Dalton Ltd.); Sonicreen (manufactured by Shinto Kogyo Co.); Turbo Screener (manufactured by Turbo Kogyo Co.); Microshifter (manufactured by Makino Sangyo Co.); and a circular vibrating sieve.

EXAMPLES

In the foregoing, the basic constitution and characteristics of the present invention have been explained. In the following, the present invention will be further described by means of examples, but the embodiments of the present invention are by no means limited to these examples. In the following examples, "part(s)" stands for "part(s) by mass" unless otherwise specified.

<Production example of binder resin 1>

| | |
|---|---|
| propoxylated bisphenol-A (2.2-mole adduct) | 25.0 mol % |
| ethoxylated bisphenol-A (2.2-mole adduct) | 23.5 mol % |
| terephthalic acid | 34.5 mol % |
| trimellitic anhydride | 5.0 mol % |
| adipic acid | 6.5 mol % |
| acrylic acid | 4.0 mol % |
| fumaric acid | 1.0 mol % |

The above polyester monomers were placed in a 4-necked flask, then the 4-necked flask was equipped with a pressure reducing apparatus, a water separator, a nitrogen gas introducing apparatus, a temperature measuring apparatus and an agitator, and agitation was carried out at 135° C. under a nitrogen atmosphere. Vinyl-type copolymerization monomers (styrene 84 mol % and 2-ethylhexyl acrylate 14 mol %), 2 mol % of a polymerization initiator (benzoyl peroxide) and 0.5 mol % (as polyester monomer) of fumaric acid were mixed so that a mass ratio of polyester units to vinyl-type copolymerization units was 4:1, and the resulting mixture was dropwise added from a dropping funnel over 4 hours to the 4-necked flask. Thereafter reaction was conducted at 135° C. for 5 hours, then the reaction temperature was elevated to 210° C. to perform polycondensation reaction under a reduced pressure of 10 kPa or lower. After the reaction was completed, the reaction mixture was taken out of the container, then cooled and ground to produce binder resin 1.

The physical properties of the binder resin 1 are shown in Table 2.

Production Example of Binder Resin 2

Binder resin 2 was produced in the same manner as in the binder resin 1 except that the monomers shown in Table 1 were used.

The physical properties of the binder resin 2 are shown in Table 2.

<Production example of binder resin 3>

| | |
|---|---|
| propoxylated bisphenol-A (2.2-mole adduct) | 25.0 mol % |
| ethoxylated bisphenol-A (2.2-mole adduct) | 23.5 mol % |
| terephthalic acid | 34.5 mol % |
| trimellitic anhydride | 1.0 mol % |
| adipic acid | 6.5 mol % |
| acrylic acid | 3.5 mol % |
| fumaric acid | 1.0 mol % |
| maleic anhydride | 1.0 mol % |
| pentaerythritol | 4.0 mol % |

The above polyester monomers were placed in a 4-necked flask, then the 4-necked flask was equipped with a pressure reducing apparatus, a water separator, a nitrogen gas introducing apparatus, a temperature measuring apparatus and an agitator, and agitation was carried out at 135° C. under a nitrogen atmosphere. Vinyl-type copolymerization monomers (styrene 84 mol % and 2-ethylhexyl acrylate 14 mol %) and 2 mol % of a polymerization initiator (benzoyl peroxide) were mixed so that a mass ratio of polyester units to vinyl-type copolymerization units was 7:3, and the resulting mixture was dropwise added from a dropping funnel over 4 hours to the 4-neckked flask. Thereafter reaction was conducted at 135° C. for 5 hours, then the reaction temperature was elevated to 220° C. to perform polycondensation reaction. After the reaction was completed, the reaction mixture was taken out of the container, then cooled and ground to produce binder resin 3.

The physical properties of binder resin 3 are shown in Table 2.

Production Examples of Binder Resins 4, 5 and 7

Binder resins 4, 5 and 7 were obtained in the same manner as in binder resin 3, except that the monomers shown in Table 1 were used and that the proportions of polyester units and vinyl-type copolymerization units were changed.

The physical properties of these resins are shown in Table 2.

Production Example of Binder Resin 6

Binder resin 6 was obtained in the same manner as in binder resin 1, except that the monomers shown in Table 1 were used.

The physical properties of the resin are shown in Table 2.

Production Examples of Binder Resins 8 and 9

Binder resins 8 and 9 were produced in the same manner as in binder resin 3, except that the monomers shown in Table 1 were used, the proportions of polyester units and vinyl-type copolymerization units were changed, and the polycondensation reaction temperature was changed to 230° C.

The physical properties of these resins are shown in Table 2.

Production Examples of Binder Resins 10 and 11

Monomers shown in Table 1 were placed in a 5-liter autoclave, then the 5-liter autoclave was equipped with a reflux condenser, a water separator, an $N_2$ gas introducing tube, a thermometer and an agitator, and polycondensation reaction was conducted at 230° C. while $N_2$ gas was introduced in the autoclave. After the reaction was completed, the reaction products was taken out of the container, then cooled and ground to produce binder resins 10 and 11.

The physical properties of these resins are shown in Table 2.

Production Example of Binder Resin 12

The polyester monomers shown in Table 1 were placed, together with an esterification catalyst, in a 4-necked flask, then the 4-necked flask was equipped with a pressure reducing apparatus, a water separator, a nitrogen gas introducing apparatus, a temperature measuring apparatus and an agitator, and the temperature was elevated to 230° C. to perform polycondensation reaction under a nitrogen atmosphere. After the reaction was completed, the reaction product was taken out of the container, then cooled and ground to produce a polyester resin. 70 parts of the polyester resin was placed again in a flask and heated to 120° C. to be melted. Then a mixture of the vinyl-type copolymerization monomers shown in Table 1 (styrene 84 mol %, butyl acrylate 7 mol % and monobutyl maleate 7 mol %) and 2 mol % of a bifunctional polymerization initiator (1,1-bis(t-butylperoxy)-2-methylcyclohexane) was dropwise added from a dropping funnel over 4 hours, and the temperature was maintained at 120° C. to perform reaction for 7 hours. Thereafter, distillation was conducted under normal pressure to eliminate xylene as a solvent, followed by distillation under reduced pressure (10 kPa or less) at 180° C. for 4 hours, thereby eliminating residual monomers and simultaneously carrying out hybridization by an ester bond between the styrene-acrylic resin and the unsaturated polyester. After the reaction was completed, the reaction product was taken out of the container, then cooled and ground to produce binder resin 12.

The physical properties of binder resin 12 are shown in Table 2.

Production Example of Binder Resin 13

180 parts of degassed water and 20 parts of a 2 mass % aqueous solution of polyvinyl alcohol were placed in a 4-necked flask, and thereto, a mixture of 70 parts of styrene, 25 parts of n-butyl acrylate, 5 parts of monobutyl maleate, 0.005 parts of divinylbenzene, and 0.1 parts of 2,2-bis(4,4-di-tert-butylperoxycyclohexyl)propane (10-hour half period temperature: 92° C.) was added, and agitated to produce a suspension.

After the interior of the flask was sufficiently replaced with nitrogen, the temperature was raised to 85° C. to initiate polymerization. After holding this temperature for 24 hours, 0.1 parts of benzoyl peroxide (10-hour half period temperature: 72° C.) were added. The polymerization was completed by holding the mixture additionally for 12 hours. Thereafter, the polymer was separated by filtration, washed with water and dried to produce binder resin 13.

The physical properties of binder resin 13 are shown in Table 2.

Production Example of Binder Resin 14

Preparation of Solution Containing Low-Molecular Weight Polymer (14L)

300 parts of xylene were placed in a 4-necked flask and, after the interior of the flask was sufficiently replaced with nitrogen under agitation, were heated and refluxed.

Under the reflux, a mixture of 76 parts of styrene., 24 parts of n-butyl acrylate and 2 parts of di-tert-butyl peroxide (initiator 1) was dropwise added over 4 hours, and the mixture was maintained for 2 hours to be polymerized, thereby obtaining a solution containing a low-molecular weight polymer (14L).

Preparation of Solution Containing High-Molecular Weight Polymer (14H)

300 parts of xylene were placed in a 4-necked flask and, after the interior of the flask was sufficiently replaced with nitrogen under agitation, were heated and refluxed.

Under the reflux, a mixture of 73 parts of styrene, 27 parts of n-butyl acrylate, 0.005 parts of divinylbenzene, and 0.8 parts of 2,2-bis(4,4-di-tert-butylperoxycyclohexyl)propane (initiator 2 ; 10-hour half period temperature: 92° C.) was dropwise added over 4 hours. After the addition was completed, the mixture was maintained for 2 hours to complete the polymerization, thereby obtaining a solution containing a high-molecular weight polymer (14H).

In a 4-necked flask, 200 parts of the solution containing the low-molecular polymer (14L) (corresponding to 30 parts of the low-molecular component) were placed, and heated and agitated under reflux. On the other hand, 200 parts of the solution containing the high-molecular weight polymer (14H) (corresponding to 70 parts of the high-molecular component) were placed in another container and refluxed. The solution containing the low-molecular weight polymer (14L) and the solution containing the high-molecular weight polymer (14H) were mixed under reflux, then xylene was distilled off, and the resulting resin was cooled to solidify and ground to produce binder resin 14.

The physical properties of binder resin 14 are shown in Table 2.

Example 1

| | |
|---|---|
| binder resin 1 | 70 parts |
| binder resin 7 | 30 parts |

-continued

| | |
|---|---|
| magnetic iron oxide particles A (number-average particle size: 0.14 μm; magnetic characteristics at 795.8 kA/m: Hc = 11.5 kA/m, $\sigma_{10k}$ = 90 $Am^2/kg$, σr = 16 $Am^2/kg$) | 70 parts |
| wax a (Fischer-Tropsch wax (melting point: 105° C.)) | 4 parts |
| charge control agent-3 | 2 parts |

The above materials were pre-mixed in a Henschel mixer, and melt-kneaded by a two-shaft kneading extruder. The kneading was conducted by controlling a detention time in such a manner that the temperature of the kneaded resin became 140 to 150° C. and by opening the vent hole of the kneader in order to reduce the pressure generated in the kneading.

The kneaded substance thus obtained was coarsely crushed by a hammer mill, then ground by means of a turbo mill, and the finely ground powder thus obtained was classified by a multidivision classifier utilizing the Coanda effect, thereby obtaining toner base particles having a weight-average particle size (D4) of 7.3 μm. To 100 parts of the toner base particles, 1.0 part of hydrophobic silica powder (BET specific surface area: 140 $m^2/g$) and 3.0 parts of strontium titanate (50% average particle size: 1.0 μm) were externally added. Thereafter, the resulting product was sieved using a sieve with a mesh size of 150 μm, thereby obtaining toner 1.

The internal addition formulation and physical properties of the toner are shown in Table 3.

Using toner 1 under environmental conditions of 23° C./5% RH, 23° C./60% RH and 32° C./80% RH in a commercially available copying apparatus (IR-6570, manufactured by Canon Inc.) which had been so modified as to have a print speed 1.5 times as fast as the original print speed, a continuous printing test was conducted in which a test chart with a print ratio of 4% was printed successively on 200,000 sheets, and the image density and fogging were evaluated at the initial stage and after the continuous printing test.

For the image density, the reflection density of a 5 mm-square image was measured with a Macbeth Densitometer (manufactured by Gretag-Macbeth Inc.) using an SPI filter. The fogging was measured with a reflection densitometer (Reflectometer Model TC-6DS, manufactured by Tokyo Denshoku Co.), and evaluation was made according to a fogging amount Ds−Dr where Ds is the worst reflection density of the white background area after image formation, and Dr is the average reflection density of the transfer material before the image formation. Therefore, it is indicated that the smaller the value, the better the fogging suppression is.

Then, the fixing property and the offset resistance were evaluated by the use of an external fixing device taken out of a commercially available copying apparatus (IR-6570, manufactured by Canon Inc.), and so modified that it was able to operate outside the copying apparatus and that the fixing roller temperature, process speed and pressure were able to be arbitrarily set.

The fixing property was evaluated by passing paper of 90 $g/m^2$ bearing two kinds of unfixed images which were a solid black image and a halftone image, through the fixing device set at a temperature of 140° C. under conditions of a process speed of 500 mm/s and a pressure of 30 $kgf/cm^2$, then rubbing the fixed images with silbon paper over 5 reciprocating cycles under a load of 50 $g/cm^2$, and determining a decrease rate (%) of the image density between before and after the rubbing. In addition, the fixing property on embossed paper was evaluated by employing, as paper having surface irregularities, Lezac 66 (151 $g/m^2$) (available from Fuji-Xerox Office Supply Co.), passing the paper bearing an unfixed solid black image and determining a decrease rate (%) of the image density in the same manner as in the above. The image density was measured with a Macbeth Densitometer (manufactured by Gretag-Macbeth Inc.) using an SPI filter, according to the following rating:

A: less than 10%;

B: 10% or more and less than 20%;

C: 20% or more.

The offset resistance was evaluated by passing paper of 50 $g/m^2$ bearing an unfixed image in an image area ratio of about 5%, through the fixing device set at a temperature of 240° C. under conditions of a process speed of 50 mm/s and a pressure of 50 $kgf/cm^2$, and observing stain on the image, according to the following rating:

A: satisfactory;

B: slight stain;

C: occurrence of stain affecting image.

The paper winding around the fixing roller was evaluated by employing second drafting paper as thin paper, and passing the paper bearing an unfixed solid black image having no end margin, through the fixing device set at a temperature of 240° C., according to the following rating:

A: no paper winding around fixing roller occurred;

B: no paper winding around fixing roller occurred, but paper was curled upon passing and offset to fixing roller occurred;

C: paper winding around fixing roller occurred.

The results of these evaluations are shown in Tables 4 to 7.

Example 2

Toner 2 was prepared in the same manner as in Example 1, except that the types and mixing ratio of resins were changed as shown in Table 3 and that the kneading was carried out with the resin temperature set at 155 to 165° C. and in a state that the vent hole for reducing the pressure was closed. The physical properties of the resulting toner are shown in Table 3. The results of the evaluations made on this toner in the same manner as in Example 1 are shown in Tables 4 to 7.

Examples 3

Toners 3 to 8 were produced in the same manner as in Example 1, except that the types and mixing ratios of resins were changed as shown in Table 3. The physical properties of the resulting toners are shown in Table 3. The results of the evaluations made on these toners in the same manner as in Example 1 are shown in Tables 4 to 7.

Comparative Examples 1 to 6

Toners 9 to 14 were produced in the same manner as in Example 1, except that the types and mixing ratios of resins and the types of charge control agents were changed as shown in Table 3. The physical properties of the resulting toners are shown in Table 3. The results of the evaluations made on these toners in the same manner as in Example 1 are shown in Tables 4 to 7.

Charge control agent-1
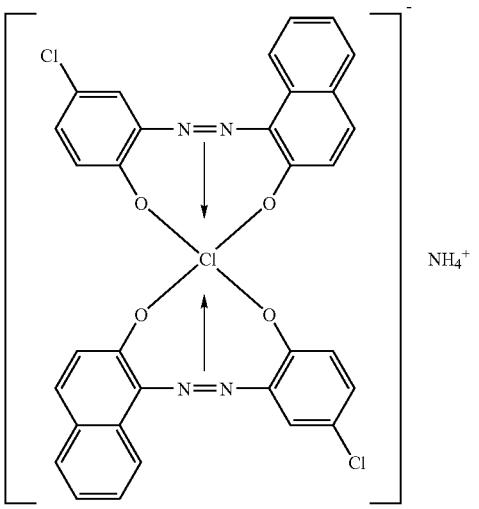
Charge control agent-2
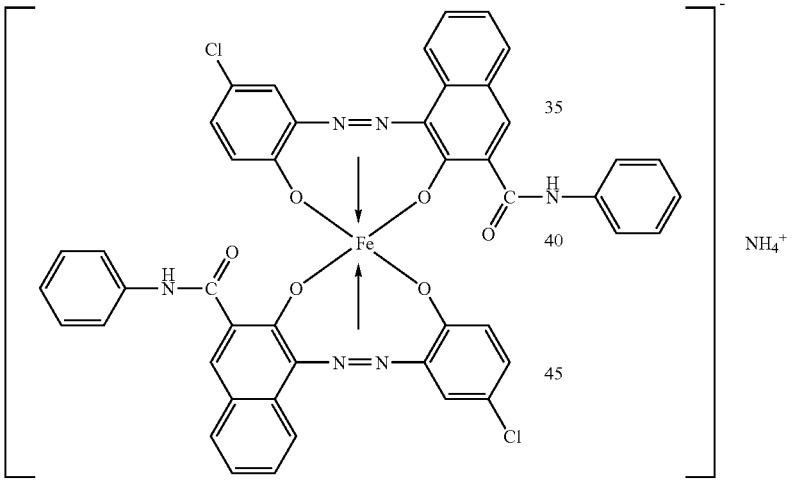
Charge control agent-3
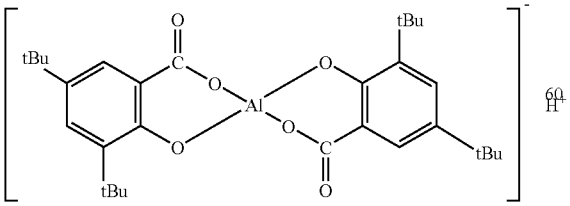

TABLE 1

| | PES amount | BPA-PO (mol %) | BPA-EO (mol %) | DSA (mol %) | TPA (mol %) | adipic acid (mol %) | TMA (mol %) |
|---|---|---|---|---|---|---|---|
| binder resin 1 | 80 | 25 | 23.5 | — | 34.5 | 6.5 | 5 |
| binder resin 2 | 75 | ↑ | ↑ | — | ↑ | ↑ | 2 |
| binder resin 3 | 70 | ↑ | ↑ | — | ↑ | ↑ | 1 |
| binder resin 4 | 75 | ↑ | ↑ | — | ↑ | ↑ | 5 |
| binder resin 5 | 80 | ↑ | ↑ | — | ↑ | ↑ | 5 |
| binder resin 6 | 80 | 26 | 22.5 | — | 33.5 | 7.5 | 5 |
| binder resin 7 | 80 | 52.6 | — | 2.6 | 39.5 | — | — |
| binder resin 8 | 80 | 32.6 | 16.3 | 6.1 | 36.7 | — | 6.1 |
| binder resin 9 | 55 | 25 | 25 | 5 | 37.5 | — | 5 |
| binder resin 10 | 100 | 46.8 | — | — | 35 | — | 11.8 |
| binder resin 11 | 100 | 47.1 | — | — | 49.6 | — | 3.3 |
| binder resin 12 | 70 | 52 | — | 13 | 8 | 10 | — |

| | FA (mol %) | maleic anhydride (mol %) | acrylic acid (mol %) | IPA (mol %) | EG (mol %) | PEL (mol %) | PNO (mol %) |
|---|---|---|---|---|---|---|---|
| binder resin 1 | 1.0/0.5 | — | 4 | — | — | — | — |
| binder resin 2 | — | 1.0/0.5 | 4 | — | 3 | — | — |
| binder resin 3 | 1 | 1 | 3.5 | — | — | 4 | — |
| binder resin 4 | ↑ | ↑ | 3.5 | — | — | — | — |
| binder resin 5 | ↑ | ↑ | ↑ | — | — | — | — |
| binder resin 6 | 0.5/1.5 | — | ↑ | — | — | — | — |
| binder resin 7 | 0.8 | — | 4.7 | — | — | — | — |
| binder resin 8 | — | — | 2.2 | — | — | — | — |
| binder resin 9 | 2.5 | — | — | — | — | — | — |
| binder resin 10 | — | — | — | 58 | — | — | 0.6 |
| binder resin 11 | — | — | — | — | — | — | — |
| binder resin 12 | 1.8 | — | — | 15.2 | — | — | — |

| | StAc amount | St (mol %) | 2EHA (mol %) | MBM (mol %) | BA (mol %) |
|---|---|---|---|---|---|
| binder resin 1 | 20 | 84 | 14 | — | — |
| binder resin 2 | 25 | ↑ | ↑ | — | — |
| binder resin 3 | 30 | ↑ | ↑ | — | — |
| binder resin 4 | 25 | ↑ | ↑ | — | — |
| binder resin 5 | 20 | ↑ | ↑ | — | — |
| binder resin 6 | 20 | 94 | 4 | — | — |
| binder resin 7 | 20 | 89.9 | 8.1 | — | — |
| binder resin 8 | 20 | 88.8 | 9.2 | — | — |
| binder resin 9 | 45 | 92.4 | — | — | 5.6 |
| binder resin 10 | 0 | — | — | — | — |
| binder resin 11 | 0 | — | — | — | — |
| binder resin 12 | 30 | 84 | — | 7 | 7 |

| | StAc amount | St (parts by mass) | 2EHA (parts by mass) | MBM (parts by mass) | BA (parts by mass) | DVB (parts by mass) |
|---|---|---|---|---|---|---|
| binder resin 13 | | 70 | — | 5 | 25 | 0.005 |
| binder resin 14L | | 76 | — | — | 24 | — |
| binder resin 14H | | 73 | — | — | 27 | 0.005 |

BPA-PO bisphenol-A, propylene oxide adduct
BPA-EO bisphenol-A, ethylene oxide adduct
DSA dodecenylsuccinic acid
TPA terephthalic acid
adipic acid
TMA trimellitic anhydride
FA fumaric acid
acrylic acid
IPA isophthalic acid
EG ethylene glycol
St styrene
2EHA 2-ethylhexyl acrylate
MBM monobutyl maleate
BA butyl acrylate
PEL pentaerythritol
PNO phenol novolak, EO adduct

TABLE 2

| | Mp | Mw | Mw/Mn | THF-insoluble matter | Tg (° C.) |
|---|---|---|---|---|---|
| binder resin 1 | 8000 | 51000 | 7.7 | 36% | 54.8 |
| binder resin 2 | 9400 | 249000 | 49.2 | 45% | 55.7 |
| binder resin 3 | 8100 | 54000 | 10.7 | 24% | 53.1 |
| binder resin 4 | 6500 | 15000 | 3.1 | 15% | 53.4 |
| binder resin 5 | 7300 | 48000 | 7.9 | 25% | 54.5 |
| binder resin 6 | 7500 | 150000 | 7.5 | 35% | 55.1 |
| binder resin 7 | 6500 | 8300 | 2.3 | 0% | 57 |
| binder resin 8 | 8300 | 106000 | 9.9 | 40% | 61.5 |

TABLE 2-continued

| | Mp | Mw | Mw/Mn | THF-insoluble matter | Tg (° C.) |
|---|---|---|---|---|---|
| binder resin 9 | 8000 | 97000 | 7.6 | 38% | 59.2 |
| binder resin 10 | 7500 | 135000 | 23.5 | 33% | 58.7 |
| binder resin 11 | 7300 | 8500 | 2.4 | 0% | 59.5 |
| binder resin 12 | 8100 | 35000 | 8.4 | 29% | 54.3 |
| binder resin 13 | 30000 | 52000 | 2.3 | 39% | 59.5 |
| binder resin 14 | * | 375000 | 55.2 | 2% | 60.3 |

* 13,000 (main)/800,000 (sub)

TABLE 3

Physical properties of toner

| | Ex. 1 | Ex. 2 | Ex. 3 | Ex. 4 | Ex. 5 | Ex. 6 | Ex. 7 | Ex. 8 |
|---|---|---|---|---|---|---|---|---|
| developer No. | 1 | 2 | 3 | 4 | 5 | 6 | 7 | 8 |
| binder resin (1) | binder resin 1 | binder resin 1 | binder resin 1 | binder resin 2 | binder resin 3 | binder resin 4 | binder resin 5 | binder resin 6 |
| binder resin (2) | binder resin 7 | binder resin 7 | binder resin 7 | binder resin 7 | binder resin 7 | binder resin 7 | binder resin 7 | binder resin 7 |
| resin mixing mass ratio ((1)/(2) | 70/30 | 70/30 | 40/60 | 70/30 | 70/30 | 70/30 | 70/30 | 70/30 |
| charge control agent | 3 | 3 | 3 | 3 | 3 | 3 | 3 | 3 |
| wax | a | a | a | a | a | a | a | a |
| magnetic iron oxide particle | A | A | A | A | A | A | A | A |
| G' (0.1) | 11000 | 9800 | 5300 | 12000 | 6700 | 8500 | 11000 | 15000 |
| G' (1000) | 220000 | 254800 | 120000 | 197000 | 219700 | 161500 | 156000 | 249000 |
| G' (1000) − G' (0.1) | 209000 | 245000 | 114700 | 185000 | 213000 | 153000 | 145000 | 234000 |
| activation energy | 89.8 | 100.5 | 111.4 | 91.4 | 112.5 | 70.3 | 98.4 | 92.1 |
| THF- insoluble matter A | 33 | 40 | 16 | 28 | 36 | 25 | 27 | 34 |
| TOL- insoluble matter B | 10 | 20 | 2.5 | 9.2 | 10.5 | 3.3 | 12 | 9 |
| B/A | 0.3 | 0.5 | 0.16 | 0.33 | 0.29 | 0.13 | 0.44 | 0.26 |

| | Comp. Ex. 1 | Comp. Ex. 2 | Comp. Ex. 3 | Comp. Ex. 4 | Comp. Ex. 5 | Comp. Ex. 6 |
|---|---|---|---|---|---|---|
| developer No. | 9 | 10 | 11 | 12 | 13 | 14 |
| binder resin (1) | binder resin 8 | binder resin 10 | binder resin 9 | binder resin 14H | binder resin 13 | binder resin 12 |
| binder resin (2) | binder resin 7 | binder resin 11 | binder resin 7 | binder resin 14L | — | binder resin 7 |
| resin mixing mass ratio ((1)/(2) | 70/30 | 50/50 | 70/30 | 30/70 | 100 | 70/30 |
| charge control agent | 3 | 2 | 1 | 2 | 1 | 3 |
| wax | a | a | a | a | a | a |
| magnetic iron oxide particles | A | A | A | A | A | A |
| G' (0.1) | 41000 | 30000 | 18000 | 38000 | 45000 | 13000 |
| G' (1000) | 500000 | 500000 | 500000 | 370000 | 490000 | 228000 |
| G' (1000) − G' (0.1) | 459000 | 470000 | 482000 | 332000 | 445000 | 215000 |
| activation energy | 121.4 | 116.4 | 111.8 | 126.1 | 122.5 | 124.5 |
| THF- insoluble matter A | 35 | 38 | 42 | 0.8 | 25 | 29 |
| TOL- insoluble matter B | 30 | 35 | 38 | 0.8 | 23 | 25 |
| B/A | 0.86 | 0.92 | 0.9 | 1 | 0.92 | 0.08 |

TABLE 4

| | Heat roller fixing device | | | | |
|---|---|---|---|---|---|
| | solid black fixing property | halftone fixing property | offset resistance | embossed paper fixing property | thin paper winding |
| Example 1 | A | A | A | A | A |
| Example 2 | B | A | A | B | A |
| Example 3 | A | A | A | B | A |
| Example 4 | A | A | A | B | A |
| Example 5 | A | A | A | A | A |
| Example 6 | A | A | B | A | A |
| Example 7 | B | A | A | A | A |
| Example 8 | A | A | A | A | A |
| Comp. Ex. 1 | C | C | C | C | B |
| Comp. Ex. 2 | C | C | C | C | B |
| Comp. Ex. 3 | B | C | C | C | B |
| Comp. Ex. 4 | C | C | C | C | B |
| Comp. Ex. 5 | C | C | C | C | B |
| Comp. Ex. 6 | C | C | B | C | C |

TABLE 5

| | Toner evaluations under high temperature and high humidity (32° C., 80% RH) | | | |
|---|---|---|---|---|
| | initial stage | | after 200000-sheet durability test | |
| | density | fogging | density | Fogging |
| Example 1 | 1.38 | 0.5 | 1.37 | 1.1 |
| Example 2 | 1.36 | 0.7 | 1.35 | 1.5 |
| Example 3 | 1.42 | 0.6 | 1.41 | 1.3 |
| Example 4 | 1.38 | 0.7 | 1.37 | 1.2 |
| Example 5 | 1.41 | 0.8 | 1.39 | 1.1 |
| Example 6 | 1.39 | 0.6 | 1.33 | 1.9 |
| Example 7 | 1.43 | 0.8 | 1.41 | 1.5 |
| Example 8 | 1.38 | 0.6 | 1.36 | 1.3 |
| Comp. Ex. 1 | 1.37 | 0.9 | 1.20 | 2.5 |
| Comp. Ex. 2 | 1.33 | 1.4 | 1.16 | 3.3 |
| Comp. Ex. 3 | 1.34 | 1.1 | 1.17 | 2.9 |
| Comp. Ex. 4 | 1.33 | 1.5 | 1.08 | 4.1 |
| Comp. Ex. 5 | 1.34 | 1.7 | 1.14 | 3.4 |
| Comp. Ex. 6 | 1.39 | 1.3 | 0.99 | 1.9 |

TABLE 6

| | Toner evaluations under normal temperature and high humidity (23° C., 60% RH) | | | |
|---|---|---|---|---|
| | initial stage | | after 200000-sheet durability test | |
| | density | fogging | density | fogging |
| Example 1 | 1.38 | 1.1 | 1.38 | 1.2 |
| Example 2 | 1.37 | 1.3 | 1.37 | 1.3 |
| Example 3 | 1.39 | 1.4 | 1.38 | 1.4 |
| Example 4 | 1.39 | 0.8 | 1.39 | 1.0 |
| Example 5 | 1.41 | 0.9 | 1.40 | 1.2 |
| Example 6 | 1.40 | 1.3 | 1.34 | 1.5 |
| Example 7 | 1.42 | 0.9 | 1.41 | 1.4 |
| Example 8 | 1.38 | 1.2 | 1.37 | 1.3 |
| Comp. Ex. 1 | 1.38 | 1.5 | 1.22 | 3.1 |
| Comp. Ex. 2 | 1.41 | 2.2 | 1.15 | 4.3 |
| Comp. Ex. 3 | 1.35 | 1.4 | 1.09 | 2.8 |
| Comp. Ex. 4 | 1.38 | 1.6 | 1.18 | 2.4 |
| Comp. Ex. 5 | 1.36 | 1.7 | 1.04 | 3.1 |
| Comp. Ex. 6 | 1.42 | 1.5 | 1.02 | 1.8 |

TABLE 7

| | Toner evaluations under normal temperature and low humidity (23° C., 5% RH) | | | |
|---|---|---|---|---|
| | initial stage | | after 200000-sheet durability test | |
| | density | fogging | density | fogging |
| Example 1 | 1.39 | 1.5 | 1.38 | 1.8 |
| Example 2 | 1.37 | 1.4 | 1.37 | 1.4 |
| Example 3 | 1.38 | 1.6 | 1.38 | 1.7 |
| Example 4 | 1.39 | 1.1 | 1.41 | 1.3 |
| Example 5 | 1.38 | 1.3 | 1.34 | 1.7 |
| Example 6 | 1.41 | 1.2 | 1.31 | 1.8 |
| Example 7 | 1.39 | 1.0 | 1.38 | 1.5 |
| Example 8 | 1.37 | 1.4 | 1.38 | 1.7 |
| Comp. Ex. 1 | 1.37 | 2.1 | 1.33 | 3.7 |
| Comp. Ex. 2 | 1.35 | 2.9 | 1.21 | 3.4 |
| Comp. Ex. 3 | 1.33 | 1.6 | 1.07 | 3.9 |
| Comp. Ex. 4 | 1.39 | 1.7 | 1.23 | 4.1 |
| Comp. Ex. 5 | 1.36 | 2.2 | 1.04 | 3.5 |
| Comp. Ex. 6 | 1.39 | 2.4 | 1.05 | 2.8 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-310876, filed Oct. 26, 2005, which is hereby incorporated by reference herein in its entirety.

What is claimed is:

1. A toner comprising at least a binder resin and a colorant, wherein, in a master curve of the toner at a reference temperature of 150° C., a difference G' (1000)−G' (0.1) between a storage modulus G' (0.1) at a frequency of 0.1 Hz and a storage modulus G' (1000) at a frequency of 1000 Hz is within a range of from 0 to $2.5\times10^5$ Pa, where an activation energy Ea determined from a shift factor aT in the state above is within a range of from 50 to 130 kJ/mol, wherein the binder resin in the toner has a low crosslinking density and contains a THF-insoluble matter A that is not extracted by a Soxhlet extraction with tetrahydrofuran (THF) for 16 hours, and the THF-insoluble matter A contains a TOL-insoluble matter B that is not extracted by a Soxhlet extraction with toluene (TOL) for 16 hours, and the THF-insoluble matter A and the TOL-insoluble matter B satisfy a relation $0.1 \leqq B/A \leqq 0.6$.

2. The toner according to claim 1, wherein the activation energy Ea of the toner is within a range of from 60 to 120 kJ/mol.

3. The toner according to claims 1, wherein the binder resin contains a polyester unit and a vinyl-type copolymerization unit.

4. The toner according to claim 3, wherein the binder resin contains 50 to 90 mass % of the polyester unit.

5. The toner according to claim 3, wherein the binder resin is a hybrid resin in which the polyester unit and the vinyl-type copolymerization unit are chemically bonded.

* * * * *